US009090082B2

(12) United States Patent
Boyd et al.

(10) Patent No.: US 9,090,082 B2
(45) Date of Patent: Jul. 28, 2015

(54) FLUID CONTAINER HAVING PLURALITY OF CHAMBERS

(75) Inventors: Patrick V Boyd, Albany, OR (US); David Olsen, Corvallis, OR (US); Ralph L. Stathem, Lebanon, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/977,206

(22) PCT Filed: Jan. 7, 2011

(86) PCT No.: PCT/US2011/020521
§ 371 (c)(1),
(2), (4) Date: Jun. 28, 2013

(87) PCT Pub. No.: WO2012/094018
PCT Pub. Date: Jul. 12, 2012

(65) Prior Publication Data

US 2013/0271537 A1 Oct. 17, 2013

(51) Int. Cl.
*B41J 2/175* (2006.01)

(52) U.S. Cl.
CPC ..... *B41J 2/17596* (2013.01); *B41J 2/17513* (2013.01)

(58) Field of Classification Search
CPC ..... B41J 2/17513
See application file for complete search history.

(56) References Cited

U.S. PATENT DOCUMENTS

| | | | |
|---|---|---|---|
| 1,641,756 | A | 9/1927 | Hass |
| 2,476,310 | A | 9/1949 | Langdon |
| 2,707,969 | A | 5/1955 | Landon |
| 3,515,169 | A | 6/1970 | Berg et al. |
| 4,450,375 | A | 5/1984 | Siegal |
| 4,771,204 | A | 9/1988 | Siegal |
| 5,737,001 | A | 4/1998 | Taylor |
| 5,912,689 | A | 6/1999 | Otsuka et al. |
| 6,145,974 | A | 11/2000 | Shinada et al. |
| 6,203,148 | B1 | 3/2001 | Kishida |
| 6,296,354 | B1 | 10/2001 | Hashimoto |
| 6,390,611 | B1 | 5/2002 | Kobayashi et al. |

(Continued)

FOREIGN PATENT DOCUMENTS

| | | |
|---|---|---|
| CN | 85203707 | 9/1986 |
| CN | 1535833 | 10/2004 |

(Continued)

OTHER PUBLICATIONS

International Search Report and Written Opinion received in PCT Application No. PCT/US2011/020521, Mailed Oct. 4, 2011, pp. 17.

*Primary Examiner* — Stephen Meier
*Assistant Examiner* — Alexander D Shenderov
(74) *Attorney, Agent, or Firm* — Hewlett-Packard Patent Department

(57) ABSTRACT

A fluid container usable with an image forming apparatus having a fluid container receiver is disclosed. The fluid container includes a housing unit including a free-fluid chamber to store a first fluid and a regulated chamber to store a second fluid. The regulated chamber includes a regulator unit configured to regulate the second fluid and an outlet configured to transport the second fluid outside of the housing unit. The fluid container also includes a fluid channel configured to establish fluid communication between ambient atmosphere and the free-fluid chamber, and a check valve configured to establish fluid communication between the free-fluid chamber and the regulated chamber.

14 Claims, 11 Drawing Sheets

(56) References Cited

U.S. PATENT DOCUMENTS

| | | | | |
|---|---|---|---|---|
| 6,533,403 | B2 | 3/2003 | Hou et al. | |
| 6,698,870 | B2 | 3/2004 | Gunther | |
| 6,773,097 | B2 * | 8/2004 | Dowell | 347/85 |
| 7,445,323 | B2 | 11/2008 | Anderson et al. | |
| 7,556,365 | B2 | 7/2009 | Stathem | |
| 7,559,634 | B2 | 7/2009 | Miyazawa | |
| 7,618,135 | B2 | 11/2009 | Stathem et al. | |
| 7,744,832 | B2 | 6/2010 | Horacek et al. | |
| 2002/0109760 | A1 | 8/2002 | Miyazawa et al. | |
| 2003/0122907 | A1 | 7/2003 | Kim | |
| 2003/0128257 | A1 * | 7/2003 | Qingguo et al. | 347/85 |
| 2004/0017444 | A1 | 1/2004 | Gunther | |
| 2008/0266370 | A1 | 10/2008 | Haines et al. | |
| 2009/0096849 | A1 | 4/2009 | Kanbe et al. | |
| 2009/0108222 | A1 | 4/2009 | Spiers et al. | |
| 2009/0109267 | A1 | 4/2009 | Lee et al. | |

FOREIGN PATENT DOCUMENTS

| | | | |
|---|---|---|---|
| CN | 1572512 | A | 2/2005 |
| CN | 1621237 | | 6/2005 |
| CN | 101073044 | | 11/2007 |
| CN | 101668637 | | 3/2010 |
| EP | 0109239 | | 5/1984 |
| EP | 1287999 | A2 | 3/2003 |
| EP | 1327524 | A1 | 7/2003 |
| EP | 1287999 | A3 | 10/2003 |
| EP | 1384588 | A1 | 1/2004 |
| EP | 1464502 | A1 | 10/2004 |
| GB | 1206556 | | 9/1970 |
| JP | 2004-58675 | A | 2/2004 |
| TW | 533135 | | 5/2003 |
| WO | WO-2005075205 | A1 | 8/2005 |
| WO | WO-2009049347 | A1 | 4/2009 |

* cited by examiner

| | HYPERINFLATION PRIMING AND/OR PURGING STATE | | |
|---|---|---|---|
| 55a | | | |
| 86 | VALVES | OPEN | CLOSE |
| 88a | REGULATOR VALVE | | X |
| 88b | FREE-FLUID VALVE | | X |
| 78c | VENT VALVE | | X |
| 89 | CAPILLARY VALVE | | X |
| 78b | WET FLOW VALVE | | X |

Fig. 11A

| | BACKPRESSURE REGULATION STATE | | |
|---|---|---|---|
| 55b | | | |
| 86 | VALVES | OPEN | CLOSE |
| 88a | REGULATOR VALVE | X | |
| 88b | FREE-FLUID VALVE | X | |
| 78a | VENT VALVE | X | |
| 89 | CAPILLARY VALVE | X | |
| 78b | WET FLOW VALVE | X | |

Fig. 11B

| | NORMAL AND/OR ALTITUDE ROBUST STATE | | |
|---|---|---|---|
| 55c | | | |
| 86 | VALVES | OPEN | CLOSE |
| 88a | REGULATOR VALVE | | X |
| 88b | FREE-FLUID VALVE | | X |
| 78a | VENT VALVE | | X |
| 89 | CAPILLARY VALVE | | X |
| 78b | WET FLOW VALVE | X | |

Fig. 11C

FLUID CONTAINER HAVING PLURALITY OF CHAMBERS

BACKGROUND

Fluid containers store fluid to be supplied to other devices. Fluid containers may include multiple chambers and be removably installed in devices such as image forming apparatuses to supply the fluid thereto. Such fluid containers may be available in a variety of fluid storage capacities.

BRIEF DESCRIPTION OF THE DRAWINGS

Non-limiting examples of the present disclosure are described in the following description, read with reference to the figures attached hereto and do not limit the scope of the claims. In the figures, identical and similar structures, elements or parts thereof that appear in more than one figure are generally labeled with the same or similar references in the figures in which they appear. Dimensions of components and features illustrated in the figures are chosen primarily for convenience and clarity of presentation and are not necessarily to scale. Referring to the attached figures:

FIG. 11A, 11B and 11C are chart representational views illustrating states of a regulated chamber of a fluid container according to examples.

Throughout the drawings, identical reference numbers designate similar, but not necessarily identical, elements.

DETAILED DESCRIPTION

In the following detailed description, reference is made to the accompanying drawings which form a part hereof, and in which is illustrated by way of illustration specific examples in which the present disclosure may be practiced. It is to be understood that other examples may be utilized and structural or logical changes may be made without departing from the scope of the present disclosure. The following detailed description, therefore, is not to be taken in a limiting sense, and the scope of the present disclosure is defined by the appended claims.

Fluid containers store fluid to be supplied to other devices and are available in a variety of fluid storage capacities. Fluid containers may also be removably installed in devices such as image forming apparatuses to supply the fluid thereto. The fluid containers may include multiple chambers to store fluid therein. The fluid containers may include regulator units to regulate the flow of fluid within and/or between the fluid container and, for example, the image forming apparatus. At times, however, fluid may be stranded in one or more of the chambers. Thus, fluid containers may be provided with active sequencing instructions, for example, from the respective image forming apparatus to control the flow of fluid. Active sequencing instructions, for example, may actively control valves to reduce a potential amount of fluid from being stranded in one or more of the chambers. Generally, however, such fluid containers controlling the flow of fluid by receiving active sequencing instructions include an increased number of parts and cost thereto.

The present disclosure discloses fluid containers having multiple fluid storage chambers including a regulated chamber and a free-fluid chamber. The regulated chamber includes a regulator unit configured to regulate respective fluid and an outlet configured to transport the respective fluid outside of the housing unit. In examples, the fluid container includes a fluid channel and a check valve. The fluid channel is configured to selectively establish fluid communication between ambient atmosphere and the free-fluid chamber. The check valve is configured to selectively establish fluid communication between the free-fluid chamber and the regulated chamber. In examples, the free-fluid chamber reaches an exhaustion state before the regulated chamber reaches the exhaustion state through passive sequencing therein. Thus, the fluid containers of the present disclosure reduce the potential amount of stranded fluid in the respective fluid storage chambers through passive sequencing. That is, in examples, the fluid containers do not require active sequencing instructions to control the flow of fluid, for example, from the respective image forming apparatus. Accordingly, the fluid containers may include a reduced number of parts and cost thereto.

Figure 1:
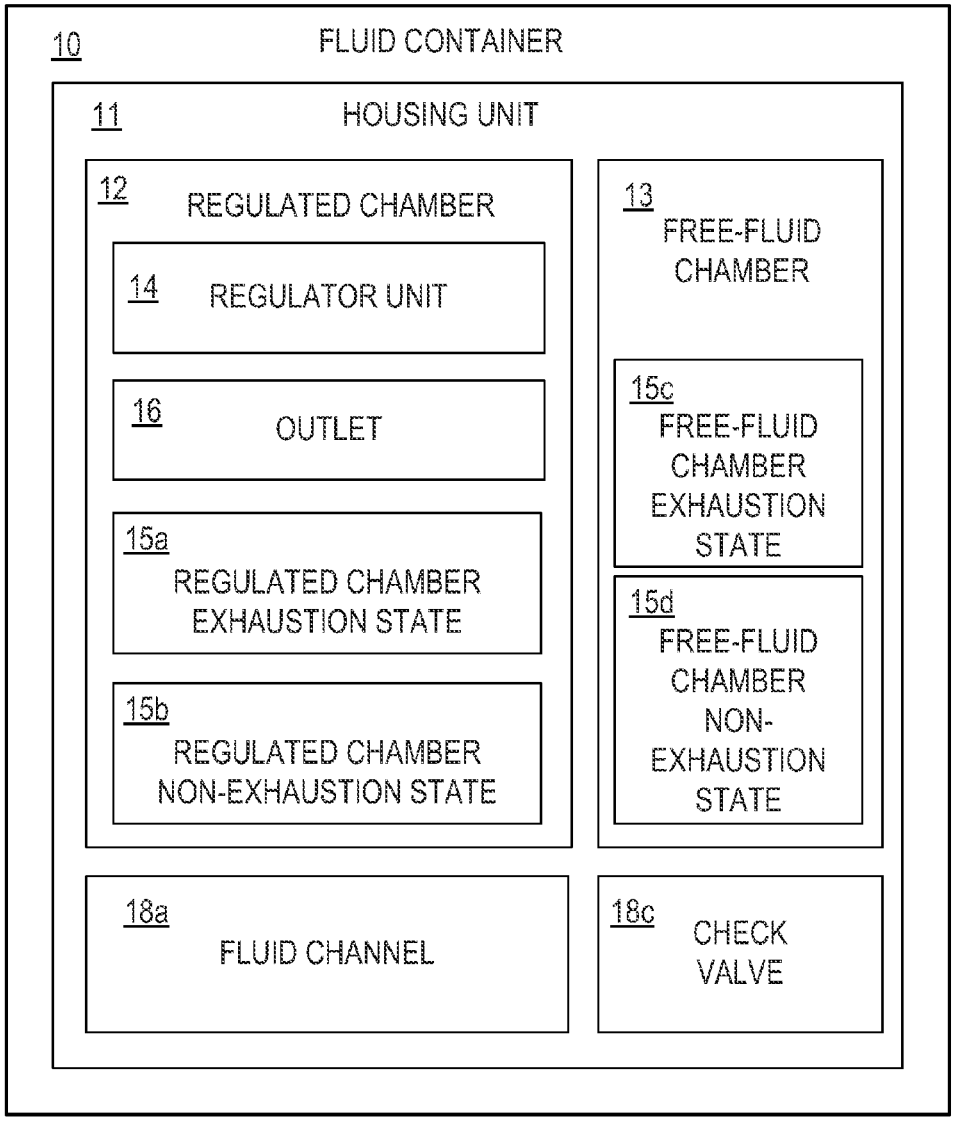
FIG. 1 is a block diagram illustrating a fluid container according to an example.
Figure 2:
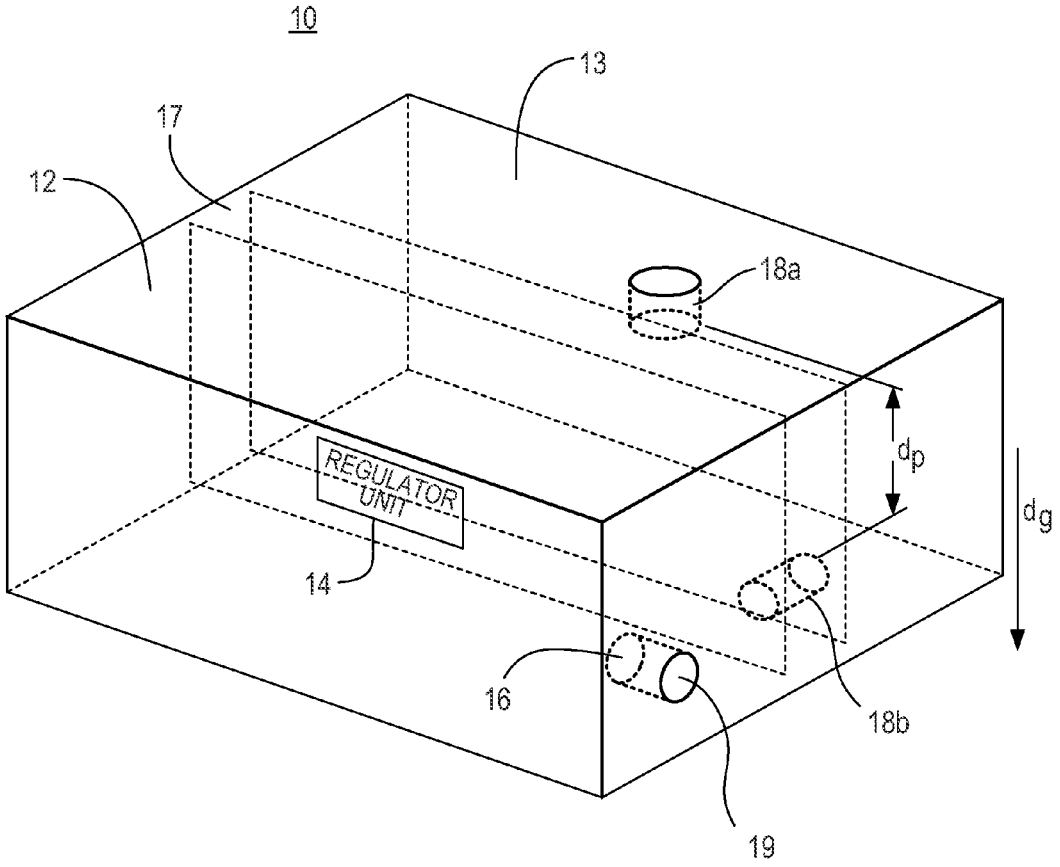
FIG. 2 is a perspective view illustrating a fluid container according to an example.
Figure 6:
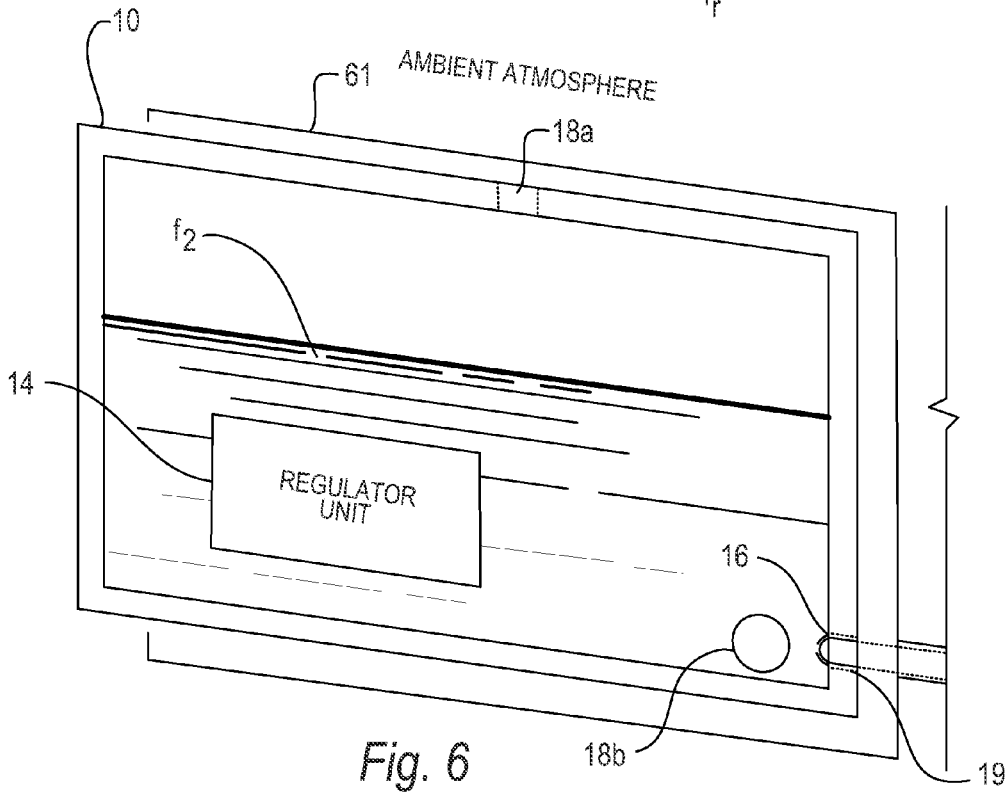
FIG. 6 is a cross-sectional view of the fluid container of FIG. 1 in an installed state according to an example.

FIG. 1 is a block diagram illustrating a fluid container according to an example. FIG. 2 is a perspective view illustrating a fluid container according to an example. The fluid container 10 may be usable with an image forming apparatus (not illustrated) having a fluid container receiver 61 (FIG. 6). Referring to FIGS. 1 and 2, in the present example, the fluid container 10 includes a housing unit 11 including a free-fluid chamber 13 to store a first fluid $f_1$ and a regulated chamber 12 to store a second fluid $f_2$. In an example, the free-fluid chamber 13 and the regulated chamber 12 may be adjacent to each other and separated by a common wall 17. The regulated chamber 12 includes a regulator unit 14 and an outlet 16. The regulator unit 14 is configured to regulate the second fluid $f_2$. The regulator unit 14 may include one or more of a pump, a biasing mechanism, a spring, a variable-volume chamber and an expansion and contraction member, or the like.

In an example, the regulated chamber 12 may include a regulated chamber exhaustion state 15*a* and a regulated chamber non-exhaustion state 15*b*. The free-fluid chamber 13 may include a free-fluid chamber exhaustion state 15*c* and a free-fluid chamber non-exhaustion state 15*d*. The respective exhaustion states 15*a* and 15*c*, for example, may be a state in which the respective chamber 12 and 13 is substantially exhausted of the respective fluid $f_2$ and $f_1$ and/or a predetermined amount of the respective fluid $f_2$ and $f_1$ has been depleted from the respective chamber 12 and 13. The respective non-exhaustion states 15*b* and 15*d*, for example, may be a state in which the respective chamber 12 and 13 is not substantially exhausted of the respective fluid $f_2$ and $f_1$ and/or a predetermined amount of the respective fluid $f_2$ and $f_1$ has not been depleted from the respective chamber 12 and 13. For example, the respective fluids $f_2$ and $f_1$ are above the respective exhaustion lines $I_r$ and $I_f$.

Referring to FIGS. 1 and 2, the outlet 16 is configured to transport the second fluid $f_2$ outside of the housing unit 11. For example, the outlet 16 may transport the second fluid $f_2$ to a fluid detector chamber (not illustrated) and/or a fluid applicator assembly (not illustrated), or the like. In an example, the fluid applicator assembly may be a print head assembly. The housing unit 11 may also include one or more exterior openings 19 such as fluid interconnects, or the like, to establish communication between a respective fluid chamber and the external environment such as an image forming apparatus and/or ambient atmosphere.

Referring to FIGS. 1 and 2, in the present example, the fluid container 10 also includes a fluid channel 18*a* and a check valve 18*b*. In the present example, the fluid channel 18*a* is configured to establish fluid communication between ambient atmosphere and the free-fluid chamber 13. In an example, the fluid channel 18*a* may include at least a vent check valve 78*a* (FIG. 7) configured to selectively transport air from ambient atmosphere to the free-fluid chamber 13. In examples, the fluid channel 18*a* may include a plurality of valves and/or an opening. The check valve 18*b* is configured to establish fluid communication between the free-fluid chamber 13 and the regulated chamber 12.

In an example, the fluid channel 18*a* is disposed on an upper portion of the housing unit 11 such as a top portion and the check valve 18*b* is disposed below the fluid channel 18*a* such as at a lower portion of the common wall 17 by a predetermined distance $d_p$ with respect to a gravitational direction $d_g$. The gravitational direction $d_g$ may be directed from a top portion of the housing unit 11 towards a bottom portion of the housing unit 11. In other examples, the common wall 17 includes at least one of the fluid channel 18*a* and the check valve 18*b* such that the check valve 18*b* is disposed below the fluid channel 18*a* by the predetermined distance $d_p$ with respect to the gravitational direction $d_g$.

Figure 3:
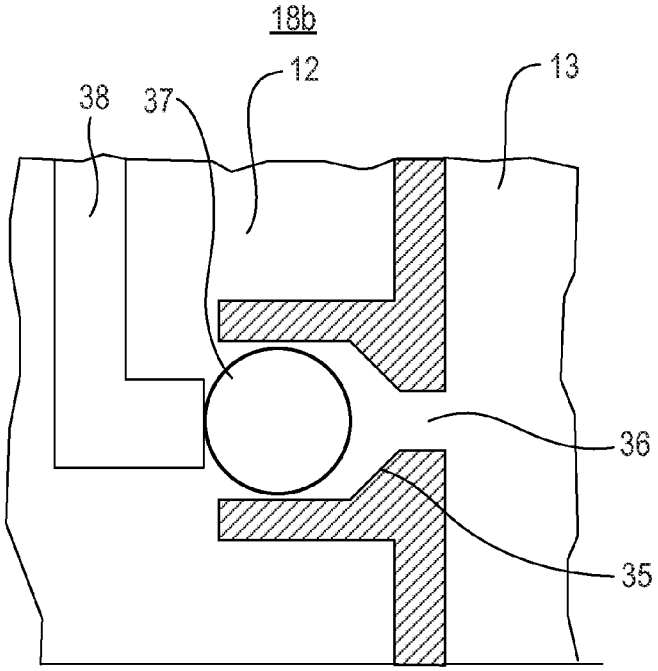
FIGS. 3 and 4 are perspective views illustrating a check valve of the fluid container of FIG. 1 according to examples.
Figure 4:
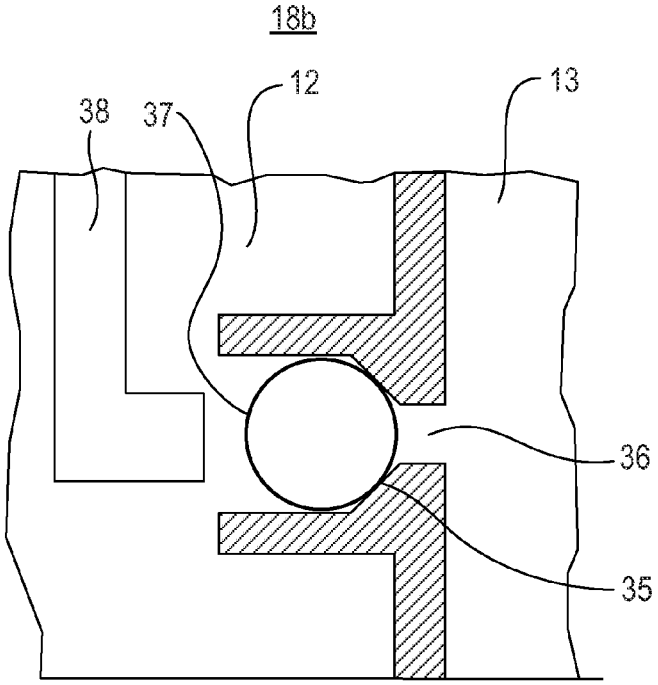

FIGS. 3 and 4 are perspective views illustrating a check valve of the fluid container of FIG. 1 according to examples. The check valve 18*b* may include a check ball 37, a port 36, a seat 35 surrounding the port 36, and a stopper 38. FIG. 3 illustrates the check valve 18*b* in an open state. That is, pressure in the free-fluid chamber 13 is greater than pressure in the regulated chamber 12 causing the check ball 37 to move away from the seat 35 and the port 36 toward the stopper 38. Alternatively, FIG. 4 illustrates the check valve 18*b* in a closed state. That is, pressure in the regulated chamber 12 is greater than pressure in the free-fluid chamber 13 causing the check ball 37 to move against the seat 35 and the port 36 from the stopper 38.

Figure 5A:
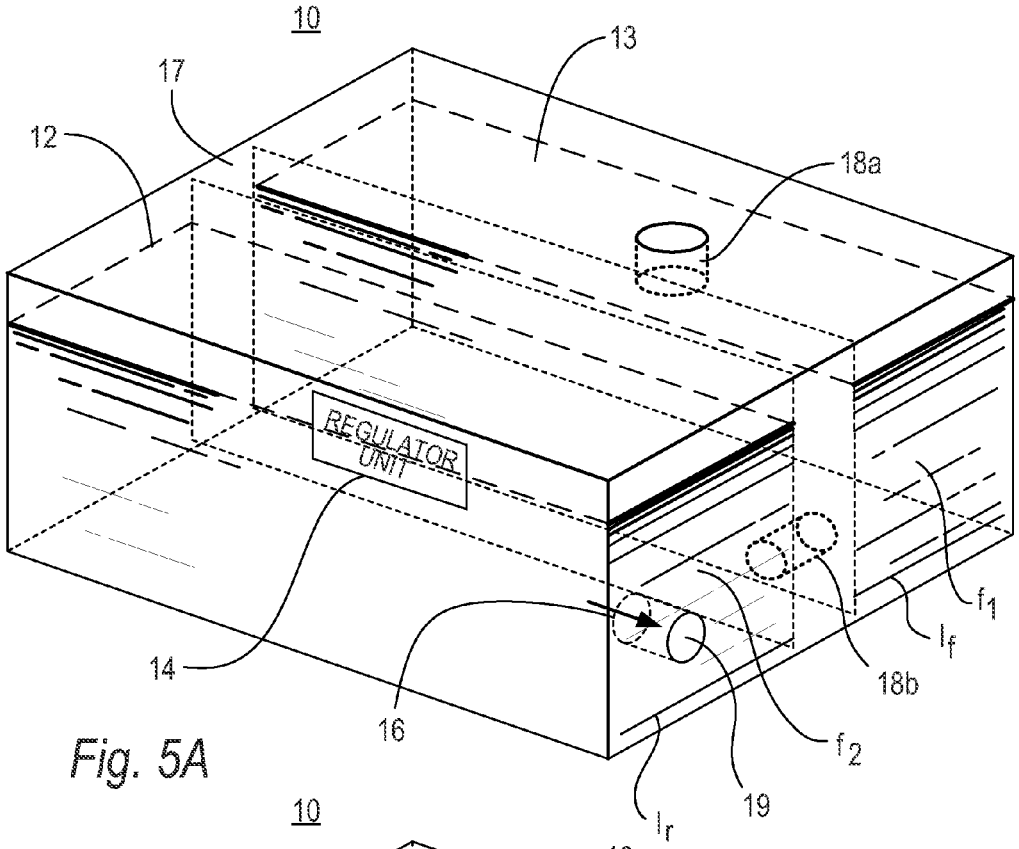
FIGS. 5A to 5E are perspective views of various stages of the fluid container of FIG. 1 according to examples.
Figure 5B:
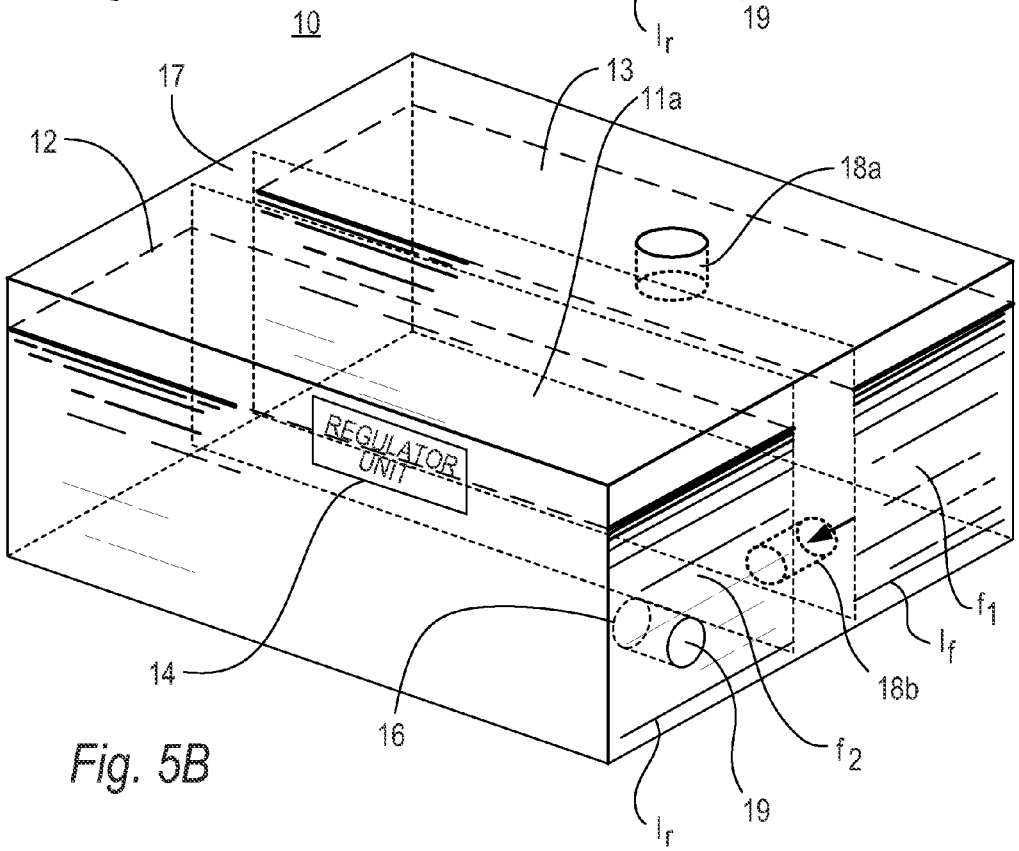
Figure 5C:
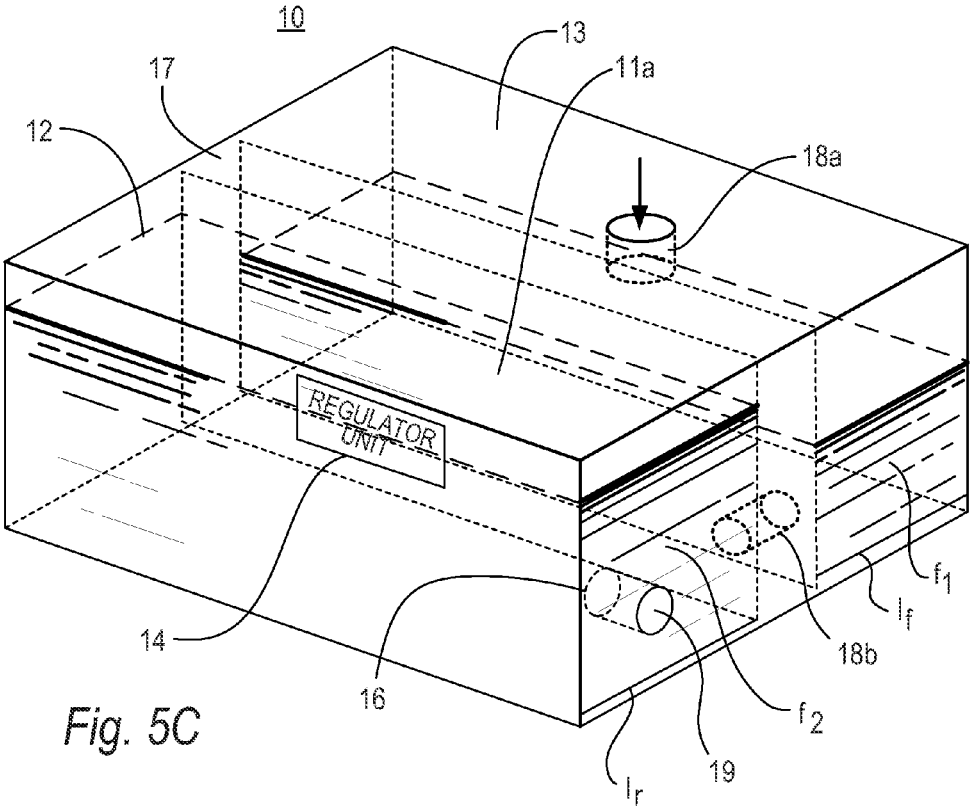
Figure 5D:
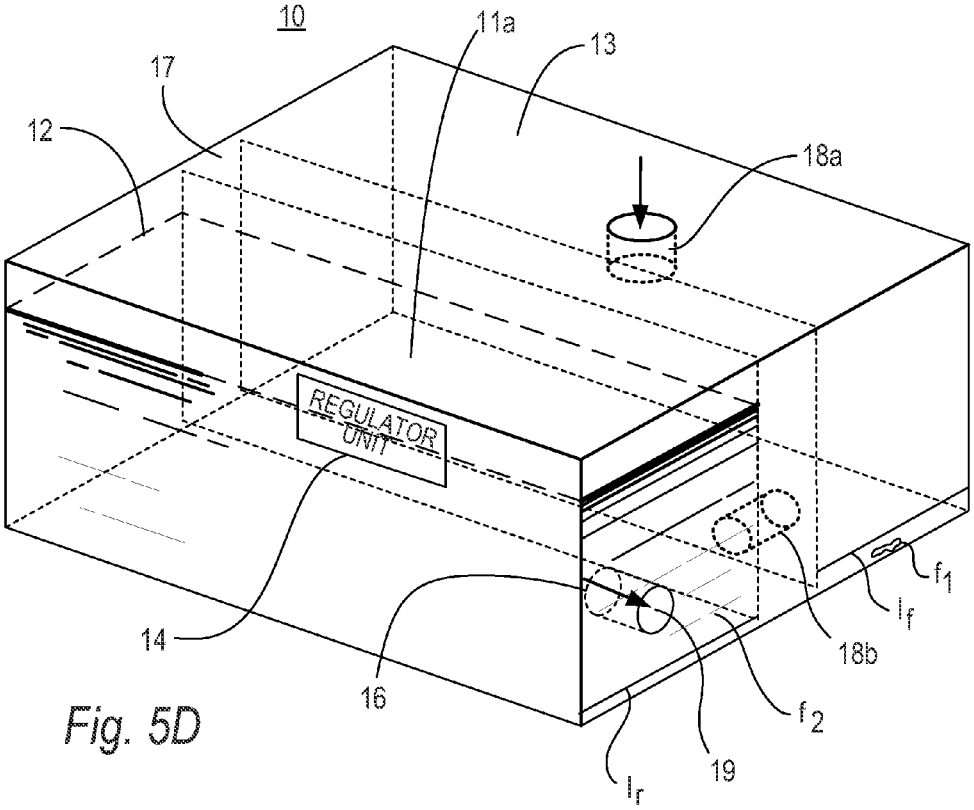
Figure 5E:
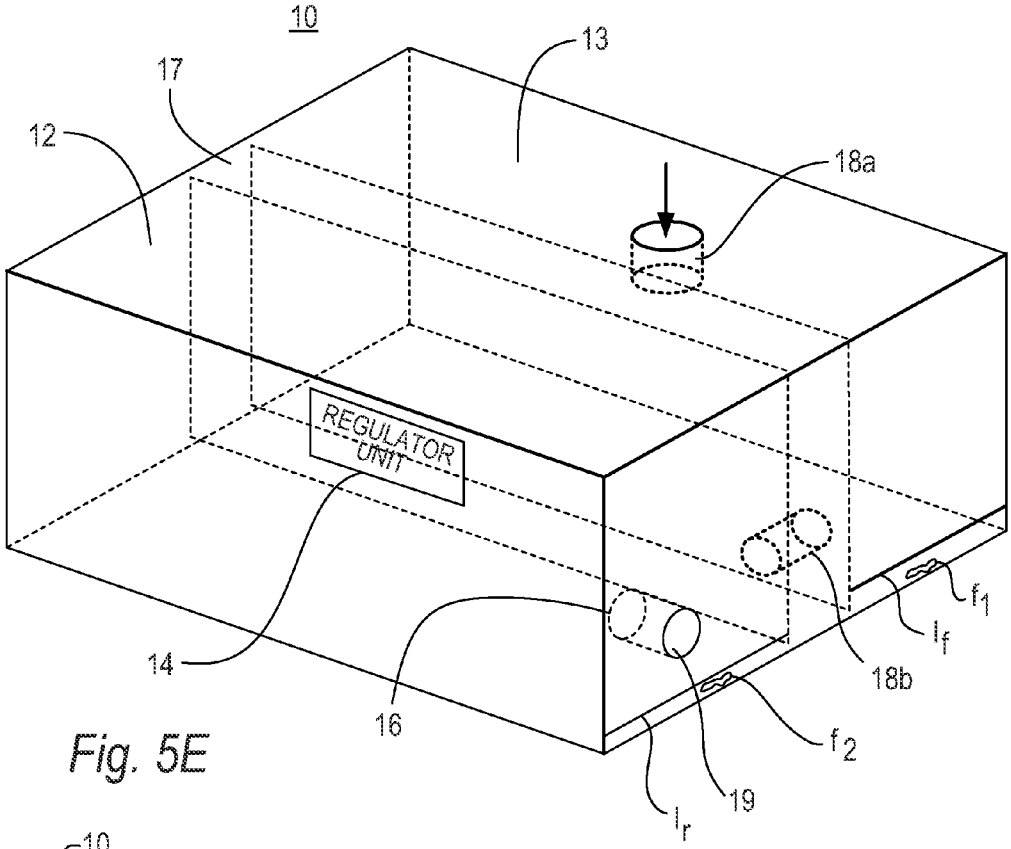

FIGS. 5A to 5E are perspective views of various stages of the fluid container of FIG. 1 according to examples. In FIGS. 5A-5C, both the regulated chamber 12 and the free-fluid chamber 13 are in a respective non-exhaustion state (15*b* and 15*d*). In FIG. 5E, both the regulated chamber 12 and the free-fluid chamber 13 are in a respective exhaustion state (15*a* and 15*c*). Referring to FIGS. 5A to 5E, in the present example, the free-fluid chamber 13 reaches a respective exhaustion state 15*c* (FIG. 5D) before the regulated chamber 12 reaches a respective exhaustion state 15*a* (FIG. 5E). The exhaustion state is a state in which a respective chamber is substantially exhausted of a particular fluid. For example, a chamber may be considered substantially exhausted of the particular fluid when the respective chamber contains an amount of the particular fluid of no more than five percent of the fluid storage capacity of the respective chamber.

In FIGS. 5A-5E, respective exhaustion lines $I_r$ and $I_f$ are indicated with respect to the regulated chamber 12 and the free-fluid chamber 13, respectively, for illustrative purposes. In the present example, the free-fluid chamber 13 reaches the free-fluid chamber exhaustion state 15*c* (FIG. 5D) before the regulated chamber 12 reaches the regulated chamber exhaustion state 15*a* (FIG. 5E) through passive sequencing therein. That is, the respective valve and/or valves do not require active sequencing instructions from the respective image forming apparatus in order to transport the respective fluid $f_1$ from the free-fluid chamber 13 to the regulated chamber 12.

Thus, in the regulated chamber 12, the second fluid $f_2$ remains above the respective exhaustion line $I_r$ at least until, in the free-fluid chamber 13, the first fluid $f_1$ falls below the respective exhaustion line $I_f$. Thus, the fluid container 10 reduces a potential amount of stranded fluid in the respective chambers 12 and 13. In the present example, the particular fluid of the free-fluid chamber 13 is the first fluid $f_1$ and the particular fluid of the regulated chamber 12 is the second fluid $f_2$. In an example, each of the first fluid $f_1$ and second fluid $f_2$ may be ink, or the like. In other examples, the first fluid $f_1$ and second fluid $f_2$ may be liquids other than ink.

As an example, if the fluid storage capacity of the regulated chamber 12 is 48 cubic centimeters (cc), the respective exhaustion state (e.g., regulated chamber exhaustion state 15*a*) of the regulated chamber 12 is when no more than 4.8 cc of a second fluid $f_2$ remains therein. If the fluid storage capacity of the free-fluid chamber 13 is 70 cc, the corresponding exhaustion state (e.g., free-fluid chamber exhaustion state 15*c*) of the free-fluid chamber 13 is when no more than 7.0 cc of the first fluid $f_1$ remains therein. Thus, in this example, an amount of the second fluid $f_2$ remaining in the regulated chamber 12 must be greater than 4.8 cc at least until the first fluid $f_1$ remaining in the free-fluid chamber 13 is 7.0 cc or less.

In an example, in response to second fluid $f_2$ being transported from the regulated chamber 12 to outside of the housing unit 11 by the outlet 16 (FIG. 5A), the first fluid $f_1$ is transported from the free-fluid chamber 13 through the check valve 18*b* to the regulated chamber 12 (FIG. 5B). Consequently, in response to the first fluid $f_1$ being transported from the free-fluid chamber 13 to the regulated chamber 12 (FIG. 5B), air is transported from the ambient atmosphere through the fluid channel 18*a* to the free-fluid chamber 13 (FIG. 5C). Further, the check valve 18*b* may be configured to selectively transport the first fluid $f_1$ from the free-fluid chamber 13 to the regulated chamber 12 in response to a pressure differential therebetween. That is, in an example, the check valve 18*b* is in an open state when pressure in the free-fluid chamber 13 is greater than pressure in the regulated chamber 12 resulting in the first fluid $f_1$ being transported through the check valve 18*b* and into the regulated chamber 12.

FIG. 6 is a cross-sectional view of the fluid container of FIG. 1 in an installed state according to an example. Referring to FIG. 6, in the present example, the fluid container 10 may include an installed state. In the installed state, the housing unit 11 is inserted into the fluid container receiver 61 of the image forming apparatus and the fluid channel 18*a* communicating with ambient atmosphere. For example, the fluid container 10 may include a removable inkjet cartridge including a regulated chamber 12 and a free-ink chamber to store ink. The housing unit 11 is configured to be received by the fluid container receiver 61 of the image forming apparatus in a manner in which the second fluid $f_2$ in the regulated chamber 12 is directed toward the check valve 18*b*. For example, a floor portion 11*a* (FIG. 5B) of the free-fluid chamber 13 may be sloped towards the check valve 18*b*.

Figure 7:
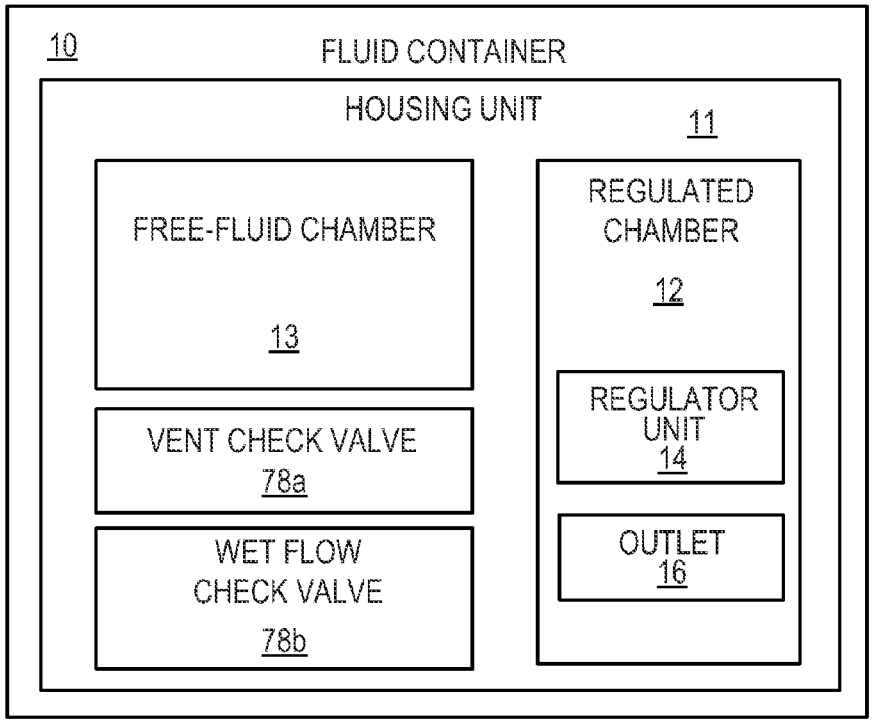
FIG. 7 is a block diagram illustrating a fluid container according to an example.

FIG. 7 is a block diagram illustrating a fluid container according to an example. The fluid container 10 may be usable with an image forming apparatus having a fluid container receiver 61 (FIG. 6). Referring to FIG. 7, in the present example, the fluid container 10 includes a housing unit 11, a free-fluid chamber 13 disposed within the housing unit 11 configured to store a first fluid $f_1$, and a regulated chamber 12 disposed within the housing unit 11 configured to store a second fluid $f_2$. The regulated chamber 12 includes a regulator unit 14 configured to regulate the second fluid $f_2$ and an outlet 16 configured to transport the second fluid $f_2$ from the regulated chamber 12 to outside of the housing unit 11. The fluid container 10 also includes a vent check valve 78*a* and a wet flow check valve 78*b*.

The vent check valve 78*a* is configured to selectively transport air between ambient atmosphere and the free-fluid chamber 13. The wet flow check valve 78*b* is configured to selectively transport the first fluid $f_1$ from the free-fluid chamber 13 to the regulated chamber 12. The wet flow check valve 78*b*, for example, may include a ball-seat check valve. In an example, the second fluid $f_2$ is transported through the outlet 16 to the outside of the housing unit 11, for example, to a print head assembly to be ejected onto a media. As a result, the first fluid $f_1$ is transported from the free-fluid chamber 13 through the wet flow check valve 78*b* to the regulated chamber 12. Further, in response to the first fluid $f_1$ being transported into the regulated chamber 12, the vent check valve 78*a* transports the air into the free-fluid chamber 13 to occupy space previously occupied by the first fluid $f_1$. The free-fluid chamber 13 of FIG. 7 may also reach the free-fluid chamber exhaustion state 15*c* before the regulated chamber 12 reaches the regulated chamber exhaustion state 15*a* through passive sequencing therein and include an installed state as previously described with reference to the fluid container 10 illustrated in FIGS. 1-6.

Figure 8:
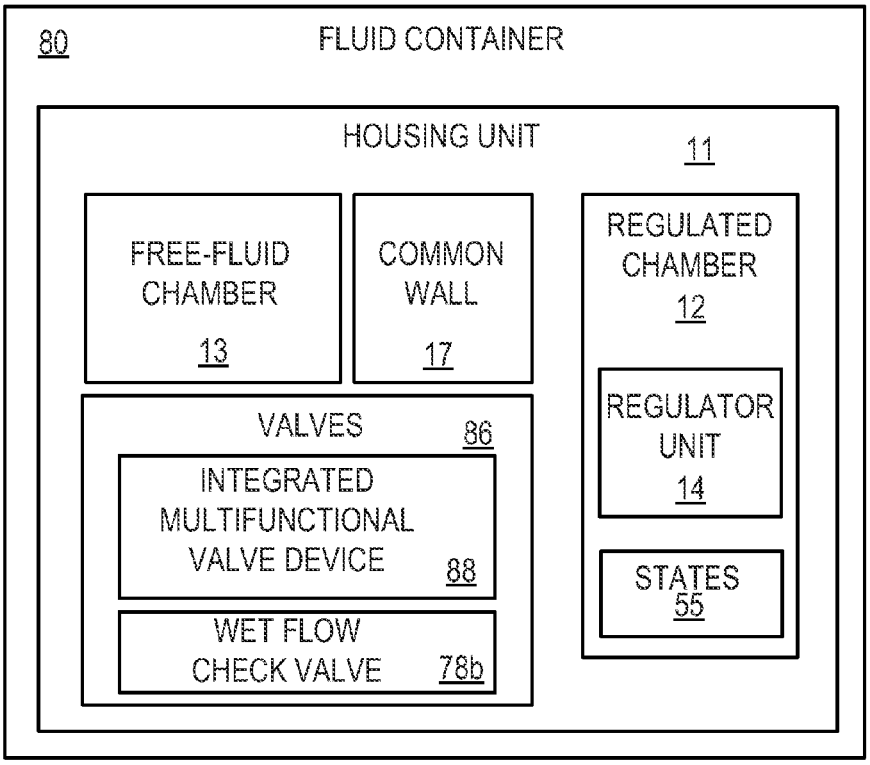
FIG. 8 is a block diagram illustrating a fluid container including an integrated multifunctional valve device according to an example.

FIG. 8 is a block diagram illustrating a fluid container including an integrated multifunctional valve device according to an example. The fluid container 80 of FIG. 8 corresponds to the fluid container 10 previously described with respect to FIG. 1. Referring to FIG. 8, the fluid container 80 includes valves 86 including an integrated multifunctional valve device 88 and a wet flow check valve 78*b*. In an example, the integrated multifunctional valve device 88 and the wet flow check valve 78*b* of the fluid container 80 of FIG. 8 may correspond with the fluid channel 18*a* and the check valve 18*b*, respectively, of the fluid container of FIG. 1. In the present example, each of the integrated multifunctional valve device 88 and the wet flow check valve 78*b* selectively isolate the free-fluid chamber 13 and the regulated chamber 12. That is, fluid communication is selectively stopped between the free-fluid chamber 13 and the regulated chamber 12. The regulated chamber 12 of the fluid container 80 may also include a plurality of states 15 such as a hyperinflation priming and/or purging state 55*a* (FIG. 11A), a backpressure regulation state 55*b* (FIG. 11B), and a normal and/or altitude robust state 55*c* (FIG. 11C).

Figure 9:
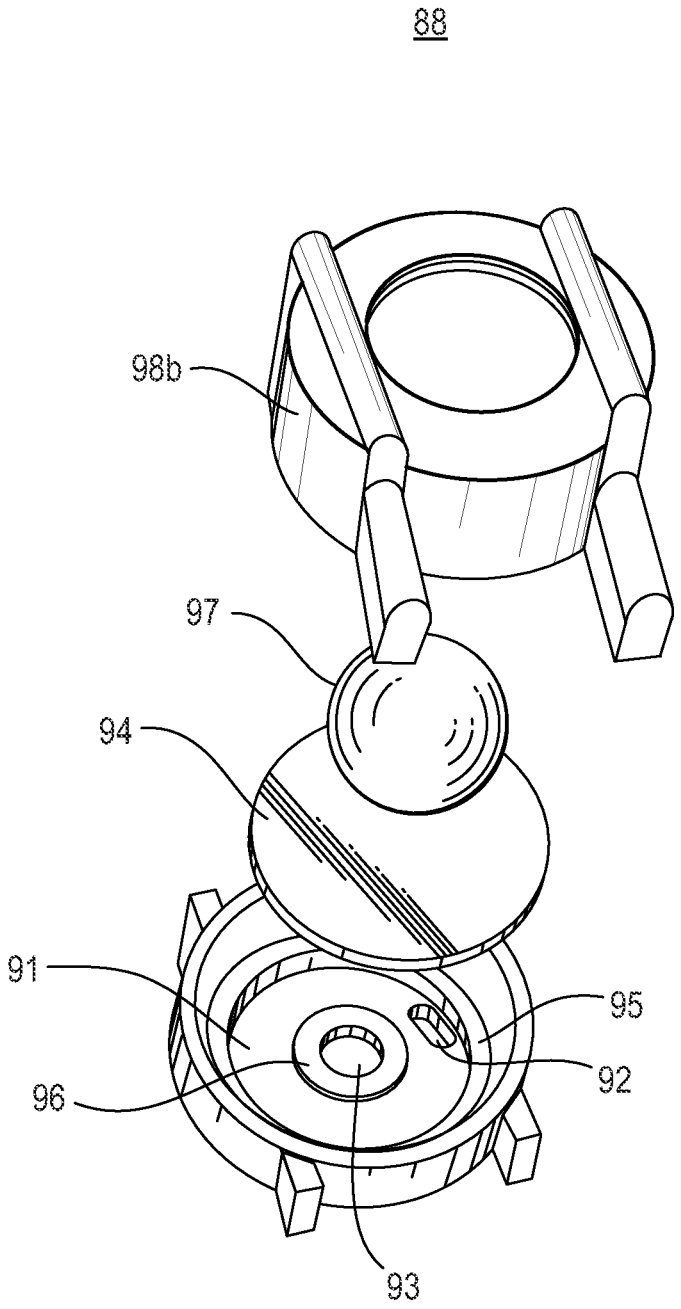
FIG. 9 is a perspective view illustrating an integrated multifunctional valve device in a disassembled form according to an example.
Figure 10A:
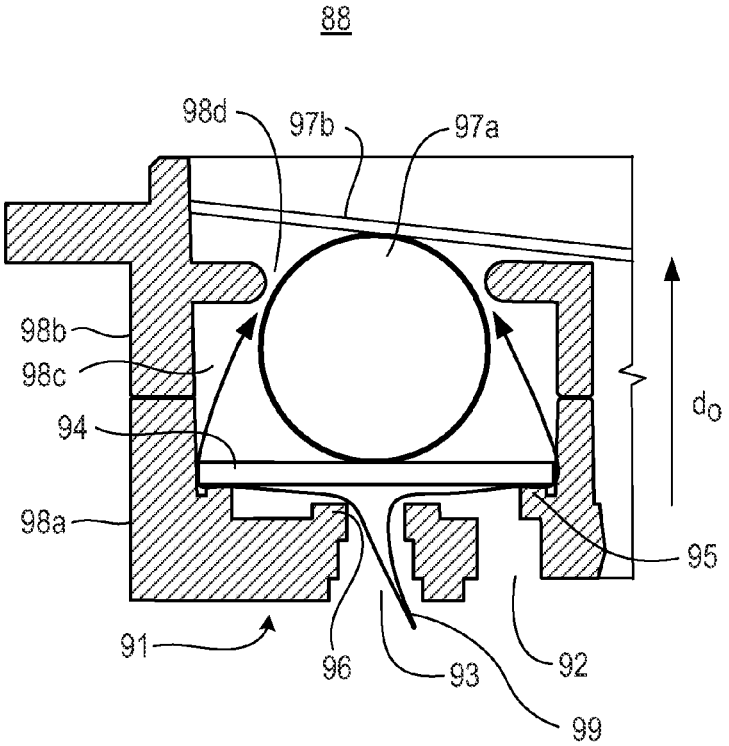
FIGS. 10A-10C are cross-sectional views illustrating the integrated multifunctional valve device of FIG. 9 in an assembled form according to examples.
Figure 10B:
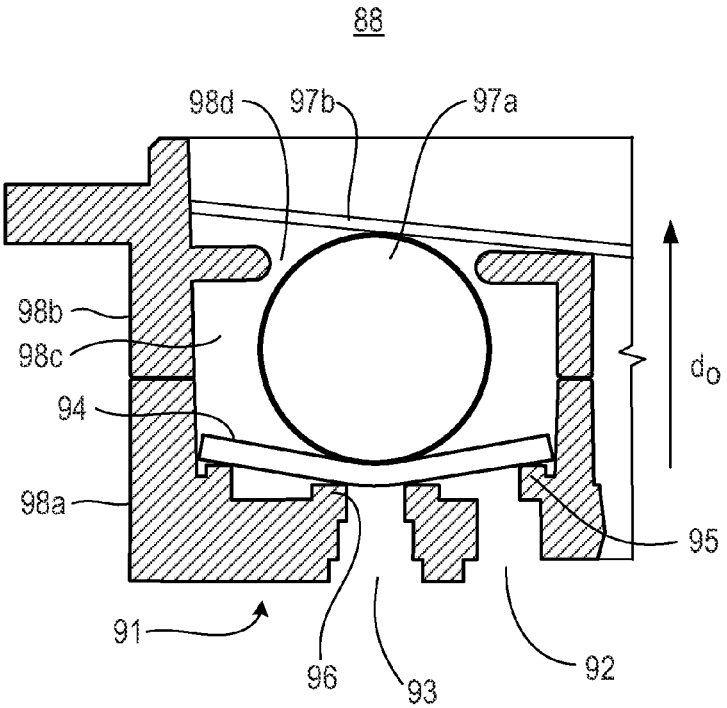
Figure 10C:
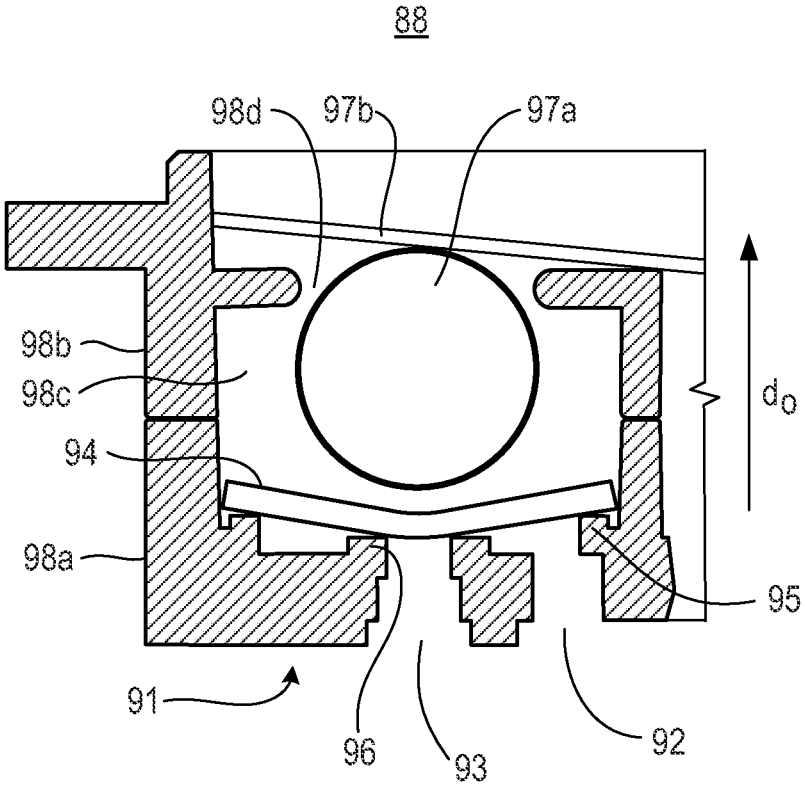

FIG. 9 is a perspective view illustrating an integrated multifunctional valve device in a disassembled form according to an example. FIGS. 10A-10C are cross-sectional views illustrating the integrated multifunctional valve device of FIG. 9 in an assembled form according to examples. The integrated multifunctional valve device 88 may be usable with a fluid container 80, for example, to direct fluid to, from and/or within the fluid container 80. Referring to FIGS. 9 and 10A-10C, in the present example, the integrated multifunctional valve device 88 may include a surface member 91 having a first port 92 and a second port 93 formed therein, a flexible disk member 94, a first seat member 95 extending outward from the surface member 91, a second seat member 96 extending outward from the surface member 91 and an actuator member 97.

The outward direction $d_o$, for example, is a direction substantially perpendicular to and away from a surface portion of the surface member 91 in which the respective ports (92 and 93) and are formed. In the present example, the surface member 91 may be a portion of the fluid container 80 such as a housing portion and/or wall portion thereof. In other examples, the surface member 91 may be separate and attachable to the fluid container 80. In an example, the fluid container 80 may also include a first housing member 98*a*, a second housing member 98*b*, and a capillary path 99. The first housing member 98*a* and the second housing member 98*b* form an enclosed chamber 98*c* therebetween.

Referring to FIGS. 9 and 10A-10C, the first housing member 98*a* may extend outward from the surface member 91 to surround the first port 92, the second port 93, the first seat member 95, the second seat member 96 and the flexible disk member 94. In an example, the first housing member 98*a* and the surface member 91 may be a unitary member. In other examples, the first housing member 98*a* may be formed separately, disposed opposite and/or coupled to the surface member 91, for example, through positioning components (not illustrated), adhesives, friction-fit arrangement, or the like. In examples, the second housing member 98*b* may be permanently or removably coupled to the first housing member 98*a*. The second housing member 98*b* includes an access opening 98*d* to provide access to inside and outside of the enclosed chamber 98*c*.

Referring to FIGS. 9 and 10A-10C, in the present example, the integrated multifunctional valve device 88 includes an integrated regulator valve 88*a* (FIGS. 11A-11C), a first pressure-actuated valve such as a free-fluid valve 88*b* (FIGS. 11A-11C) and a second pressure-actuated valve such as a vent valve 78*a* (FIGS. 11A-11C). The regulator valve 88*a* includes an actuator member such as the lever member 97*b* and an actuator ball 97*a*, the flexible disk member 94, the first seat member 95, the second seat member 96, the first port 92 and the second port 93. The regulator valve 88*a* has an open state corresponding to the open port position of the flexible disk member 94 and a closed state corresponding to the close port position of the flexible disk member 94. In the open port position, the flexible disk member 94 moves away from the second seat member 96. That is, the flexible disk member 94 moves away from the respective port 93. Thus, in the open state, the regulator valve 88*a* establishes fluid communication between the first port 92 and the second port 93. In the close port position, the flexible disk member 94 is urged against and extends across the first seat member 95 and the second seat member 96. That is, the flexible disk member 94 is urged towards the respective port 93. Thus, in the closed state, the regulator valve 88*a* stops the fluid communication between the first port 92 and the second port 93.

Referring to FIGS. 9 and 10A, in the present example, the integrated multifunctional valve device 88 includes the flexible disk member 94, the first seat member 95, the second seat member 96 and the first port 92 to form a first pressure-actuated valve corresponding to the open state of the regulator valve 88*a*. The flexible disk member 94, the second seat member 96 and the second port 93 form a second pressure-actuated valve corresponding to the open state of the regulator valve 88*a*. That is, adequate pressure may urge at least a portion of the flexible disk member 94 against the second seat member 96 thereby covering the second port 93, even when the lever member 97*b* and actuator ball 97*a* do not move at least a portion of the flexible disk member 94 into the close port position (FIG. 10C).

The free-fluid valve 88*b* may be configured to selectively transport air from the vent valve 78*a* into the free-fluid chamber 13. The vent valve 78*a* may be configured to selectively transport air from ambient atmosphere to the free-fluid valve 88*b*. In examples, one or more of the regulator valve 88*a*, the first pressure-actuated valve and the second pressure-actuated valve may be check valves. In the present example, each of the regulator valve 88*a*, the first pressure-actuated valve and the second pressure-actuated valve are check valves.

Referring to FIG. 10A, in an example, the integrated multifunctional valve device 88 may include a capillary relief valve 89 (FIGS. 11A-11C). In an example, the flexible disk member 94, the first seat member 95, the first housing member 98*a*, the second seat member 96 and the second port 93 form a capillary relief valve 89 corresponding to the open position of the regulator valve 88*a*. In examples, the second housing member 98*b*, the actuator ball 97*a*, the flexible disk member 94, the first seat member 95, the first housing member 98*a*, the second seat member 96, and the second port 93 form a capillary relief valve 89 corresponding to the open position of the regulator valve 88*a*. The capillary path 99 may be configured to selectively transport air from the second port 93 to the regulated chamber 12. In an example, the capillary path 99 selectively transports air from the second port 93 to the regulated chamber 12 based on a respective state 55 of the regulated chamber 12 such as the backpressure regulation state 55*b* (FIG. 11B).

FIG. 11A, 11B and 11C are chart representational views illustrating states of the regulated chamber of the fluid container of FIG. 1 according to examples. In examples, the plurality of states 15 may be a combination of pressurization and depressurization states. Referring to FIGS. 11A-11C, in the present example, the states 55 (FIG. 7) include a hyperinflation priming and/or purging state 55*a* (FIG. 11A), a backpressure regulation state 55*b* (FIG. 11B), and a normal and/or altitude robust state 55*c* (FIG. 11C). In the hyperinflation priming and/or purging state 55*a*, the regulator unit 14 is configured to pressurize the regulated chamber 12 to a positive pressure to perform at least one of a priming function and a purging function, such that the wet flow valve 78*b* is closed. That is, the regulated chamber 12 has a greater pressure than the free-fluid chamber 13. Further, the regulator valve 88*a* is closed, the free-fluid valve 88*b* is closed, the vent valve 78*a* is closed, and a capillary relief valve 89 is closed.

Referring to FIGS. 10C and 11A, for example, in operation in the hyperinflation priming and/or purging state 55*a*, the regulator unit 14 expands to pressurize the regulated chamber 12 and, for example, to move a lever member 97*b* in a direction away from a respective port 93. The actuator ball 97*a* also moves away from the respective port 93. However, pressure within the regulated chamber 12 places a flexible disk member 94 into a closed port position and closes the wet flow valve 78*b*. That is, the flexible disk member 94 is urged toward and against the respective port 93 to cover it isolating the free-fluid chamber 13 from the regulated chamber 12. In an example, the capillary relief valve 89 is closed.

Referring to FIGS. 10A and 11B, in the backpressure regulation state 55*b*, the regulator unit 14 is configured to form a negative pressure in the regulated chamber 12 to perform a controlled fluid delivery function, such that the wet flow valve 78*b* is open, the regulator valve 88*a* is open, the free-fluid valve 88*b* is open, the vent valve 78*a* is open, and a capillary relief valve 89 is closed. That is, pressure in the regulated chamber 12 is less than pressure in the free-fluid chamber 13. For example, in operation in the backpressure regulation state 55*b*, back pressure expands the regulator unit 14 to pressurize the regulated chamber 12 and, for example, to move a lever member 97*b* in a direction away from the respective port 93. The actuator ball 97*a* also moves away from the respective port 93. The flexible disk member 94 is placed in an open port position and the wet flow valve 78*b* is placed into an open position. That is, air flows through the vent valve 78*a* and free-fluid valve 88*b* into the free-fluid chamber 13. Also, fluid flows from the free-fluid chamber 13 through the wet flow valve 78*b* into the regulated chamber 12. In an example, the capillary relief valve 89 is open. Thus, air does passes through the capillary relief valve 89 into the regulated chamber 12, for example, along a capillary path 99.

As illustrated in FIGS. 10B and 11C, in the normal and/or altitude robust state 55*c*, the regulator unit 14 is in a partially expanded state configured to form a negative pressure in the regulated chamber 12 to perform at least a leak prevention function, such that the wet flow valve 78*b* is open, the regulator valve 88*a* is closed, the free-fluid valve 88*b* is closed, the vent valve 78*a* is closed, and a capillary relief valve 89 is closed. For example, in operation in the normal and/or altitude robust state 55*c*, the regulator unit 14 partially expands. The flexible disk member 94 is urged against the respective port, for example, by the lever member 97*b* and/or actuator ball 97*a*, or the like. Thus, the flexible disk member 94 is placed in a closed port position restricting air from flowing into the free-fluid chamber 13 through the vent valve 78*a* and free-fluid valve 88*b*. The wet flow valve 78*b* is in an open position allowing fluid to flow into the regulated chamber 12 as the pressure in the regulated chamber 12 is less than the pressure in the free-fluid chamber 13. In an example, the capillary relief valve 89 is closed.

The present disclosure has been described using non-limiting detailed descriptions of examples thereof that are provided by way of example and are not intended to limit the scope of the present disclosure. It should be understood that features and/or operations described with respect to one example may be used with other examples and that not all examples of the present disclosure have all of the features and/or operations illustrated in a particular figure or described with respect to one of the examples. Variations of examples described will occur to persons of the art. Furthermore, the terms "comprise," "include," "have" and their conjugates, shall mean, when used in the disclosure and/or claims, "including but not necessarily limited to."

It is noted that some of the above described examples that are illustrative and therefore may include structure, acts or details of structures and acts that may not be essential to the present disclosure and which are described as examples. Structure and acts described herein are replaceable by equivalents, which perform the same function, even if the structure or acts are different, as known in the art. Therefore, the scope of the present disclosure is limited only by the elements and limitations as used in the claims.

What is claimed is:

1. A fluid container usable with an image forming apparatus having a fluid container receiver, the fluid container comprising:

a housing unit including a free-fluid chamber to store a first fluid and a regulated chamber to store a second fluid, the regulated chamber including a regulator unit to regulate the second fluid and an outlet to transport the second fluid outside of the housing unit;

a fluid channel to establish fluid communication between ambient atmosphere and the free-fluid chamber; and a check valve to establish fluid communication between the free-fluid chamber and the regulated chamber; and wherein the free-fluid chamber reaches a respective exhaustion state before the regulated chamber reaches the respective exhaustion state, wherein, in an installed state, the housing unit is to be received by the fluid container receiver such that a floor portion of the regulated chamber is sloped to direct the second fluid in the regulated chamber toward the check valve.

2. The fluid container according to claim 1, wherein the free-fluid chamber reaches the respective exhaustion state before the regulated chamber reaches the respective exhaustion state through passive sequencing therein.

3. The fluid container according to claim 1, wherein the first fluid is transported from the free-fluid chamber through the check valve to the regulated chamber in response to the second fluid being transported from the regulated chamber through the outlet to outside of the housing unit.

4. The fluid container according to claim 3, wherein air is transported from the ambient atmosphere through the fluid channel to the free-fluid chamber in response to the transport of the first fluid being transported from the free-fluid chamber to the regulated chamber.

5. The fluid container according to claim 1, wherein the check valve is to selectively transport the first fluid from the free-fluid chamber to the regulated chamber in response to a pressure differential therebetween.

6. The fluid container according to claim 1, wherein the free-fluid chamber and the regulated chamber are adjacent to each other and separated by a common wall such that the common wall includes at least one of the fluid channel and the check valve, the check valve is disposed below the fluid channel by a predetermined distance with respect to a gravitational direction.

7. The fluid container according to claim 1, wherein the fluid channel comprises:

at least a vent check valve to selectively transport air from ambient atmosphere to the free-fluid chamber.

8. A fluid container usable with an image forming apparatus having a fluid container receiver, the fluid container comprising:

a housing unit;

a free-fluid chamber disposed within the housing unit and to store a first fluid;

a regulated chamber disposed within the housing unit and to store a second fluid, the regulated chamber including a regulator unit to regulate the second fluid and an outlet to transport the second fluid from the regulated chamber to outside of the housing unit;

a common wall disposed within the housing unit to separate the free-fluid chamber and the regulated chamber;

a vent check valve to selectively transport air between ambient atmosphere and the free-fluid chamber; and a wet flow check valve to selectively transport the first fluid from the free-fluid chamber to the regulated chamber;

wherein the wet flow check valve communicates with an opening through the common wall to selectively transport the first fluid from the free-fluid chamber to the regulated chamber through the common wall; and wherein the wet flow check valve transports the first fluid in response to the transport of the second fluid through the outlet to the outside of the housing unit, and the vent check valve transports the air into the free-fluid chamber in response to the transport of the first fluid into the regulated chamber.

9. The fluid container according to claim 8, wherein the wet flow check valve is to selectively transport the first fluid from the free-fluid chamber to the regulated chamber in response to a pressure differential therebetween.

10. The fluid container according to claim 8, wherein the housing unit comprises a removable inkjet cartridge and the free-fluid chamber comprises a free-ink chamber.

11. The fluid container according to claim 8, wherein the common wall extends a full depth of the free-fluid chamber and the regulated chamber.

12. The fluid container according to claim 8, wherein the wet flow check valve is disposed below the vent check valve by a predetermined distance in a gravitational direction.

13. The fluid container according to claim 8, wherein, in an installed state, the housing unit is to be received by the fluid container receiver such that a floor portion of the regulated chamber is sloped to direct the second fluid in the regulated chamber toward the check valve.

14. The fluid container according to claim 8, wherein the free-fluid chamber reaches a respective exhaustion state before the regulated chamber reaches the respective exhaustion state through passive sequencing therein.

* * * * *